United States Patent [19]

Pyle et al.

[11] 4,084,912

[45] Apr. 18, 1978

[54] METHOD AND ASSEMBLY FOR SEALING GAPS BETWEEN ADJACENT ROADWAY SLABS

[75] Inventors: Lawrence F. Pyle, Des Plaines; John F. Brady, Wood Dale, both of Ill.

[73] Assignee: Felt Products Mfg. Co., Skokie, Ill.

[21] Appl. No.: 706,691

[22] Filed: Jul. 19, 1976

[51] Int. Cl.[2] ..... E01C 11/02

[52] U.S. Cl. ..... 404/74; 404/69; 404/64

[58] Field of Search ..... 404/74, 64, 67, 65, 404/66, 69, 68, 22, 47; 52/593, 232

[56] References Cited

U.S. PATENT DOCUMENTS

| | | | |
|---|---|---|---|
| 1,814,127 | 7/1931 | Christians | 404/47 X |
| 2,625,086 | 1/1953 | Ulrich | 404/74 |
| 2,951,006 | 8/1960 | Rubenstein | 52/DIG. 7 |
| 3,707,062 | 12/1972 | Joiner | 52/173 X |
| 3,713,368 | 1/1973 | McDowell | 404/69 |
| 3,827,817 | 8/1974 | Czernik | 404/67 |
| 3,992,121 | 11/1976 | Geiger | 404/47 |

*Primary Examiner*—Nile C. Byers
*Attorney, Agent, or Firm*—Dressler, Goldsmith, Clement, Gordon & Shore, Ltd.

[57] ABSTRACT

A method and gap sealing assembly for sealing adjacent roadway slabs at the gap. Gap sealing members bridging the gap are positioned in end-to-end array. A resistance heater is positioned adjacent elastomeric end surfaces of the members and a rubber-like heat activatable bonding agent is positioned between the end surfaces. When the heater is energized, the end surfaces are bonded to each other to form a seal in situ.

6 Claims, 14 Drawing Figures

FIG. 1
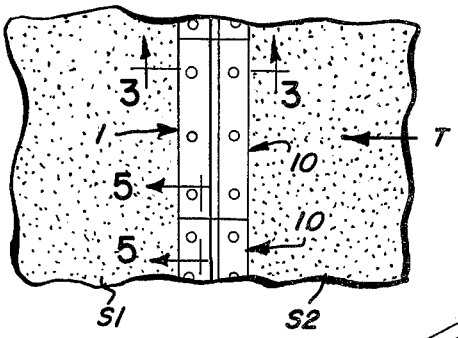
FIG. 2
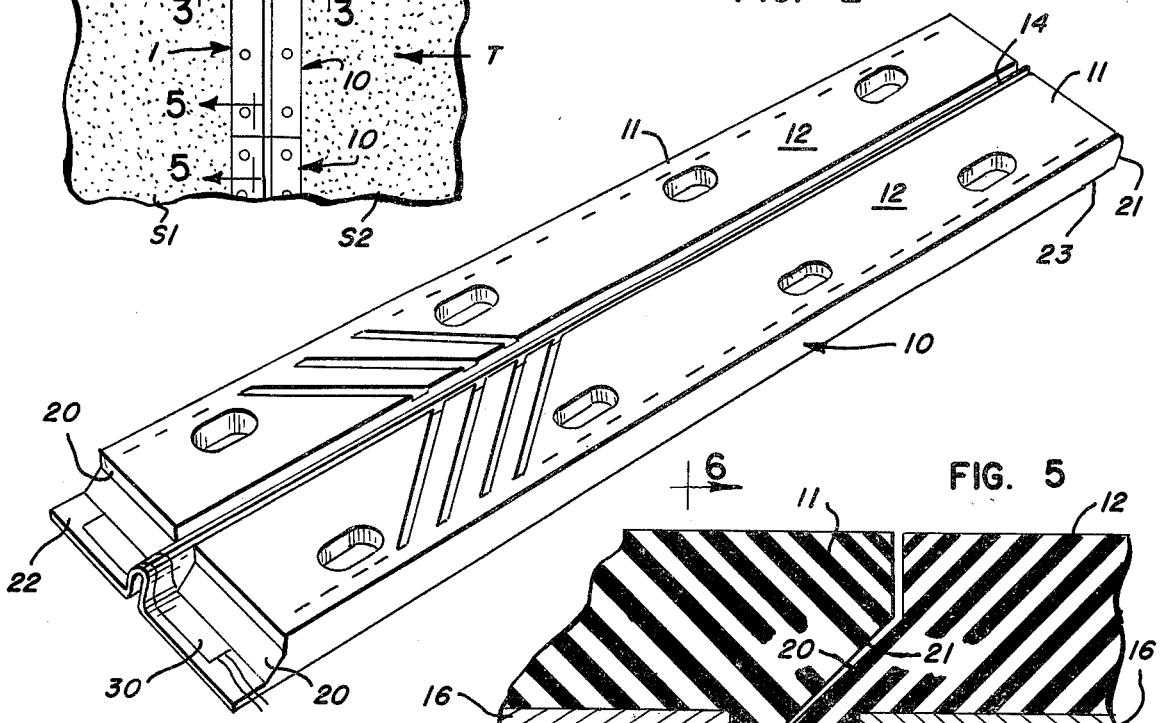
FIG. 5
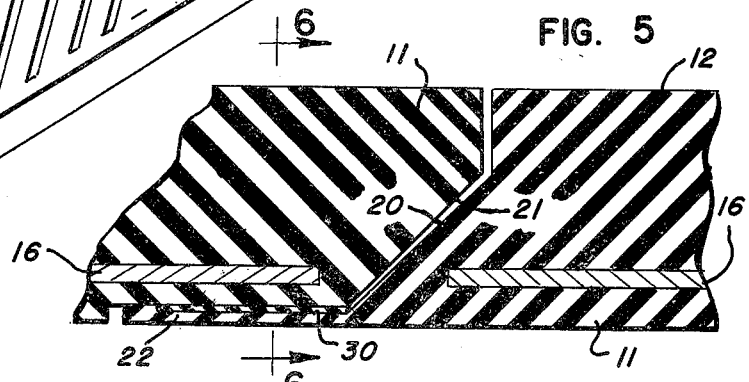
FIG. 3
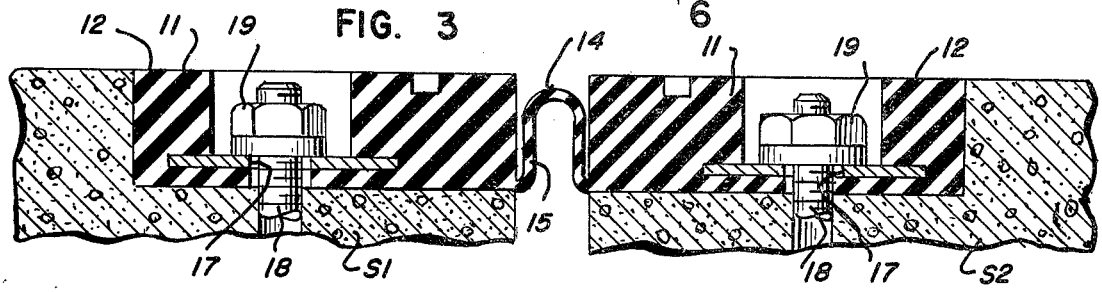
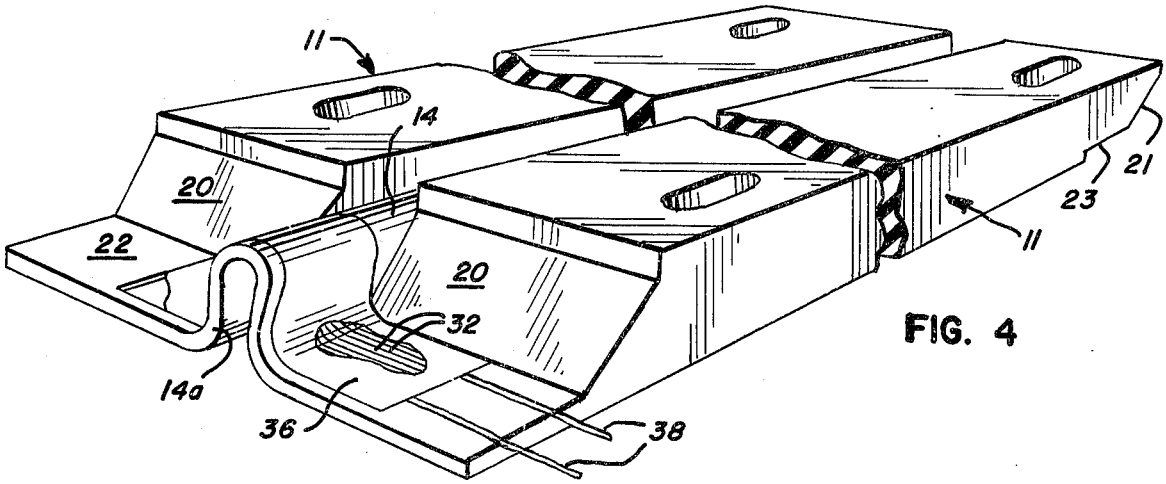
FIG. 4

FIG. 8
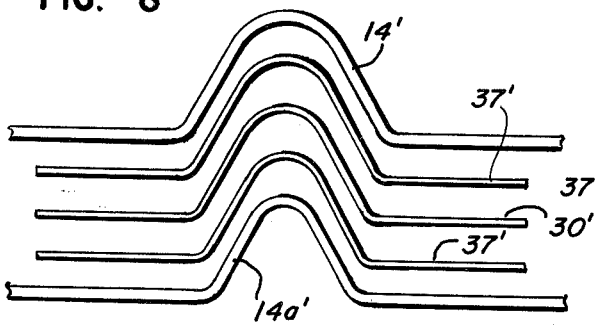
FIG. 7
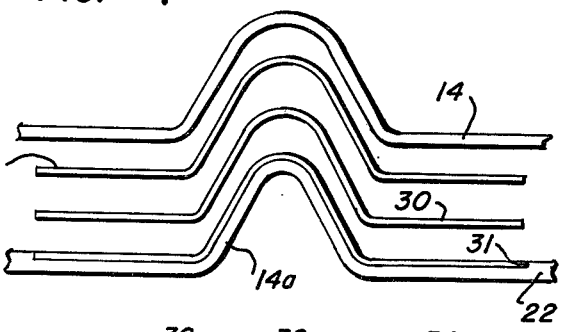
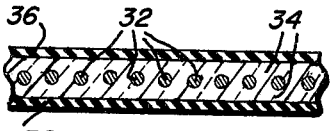
FIG. 6a
FIG. 6
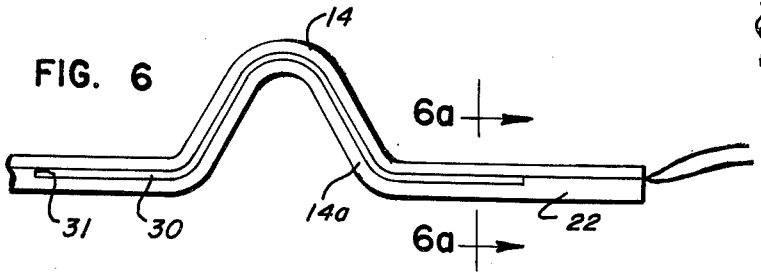
FIG. 9
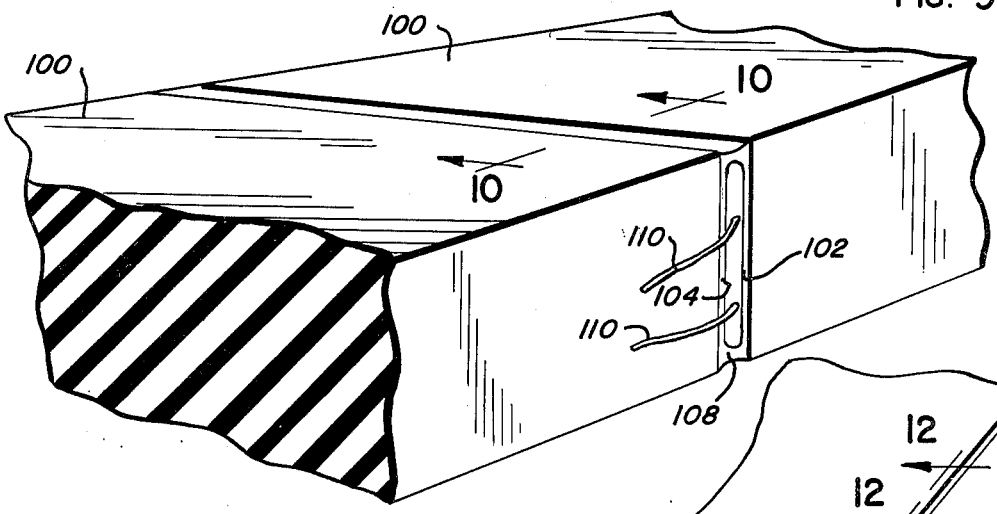
FIG. 10
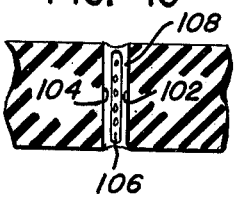
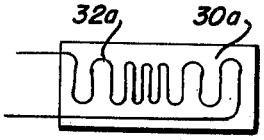
FIG. 13
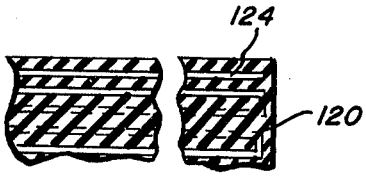
FIG. 12
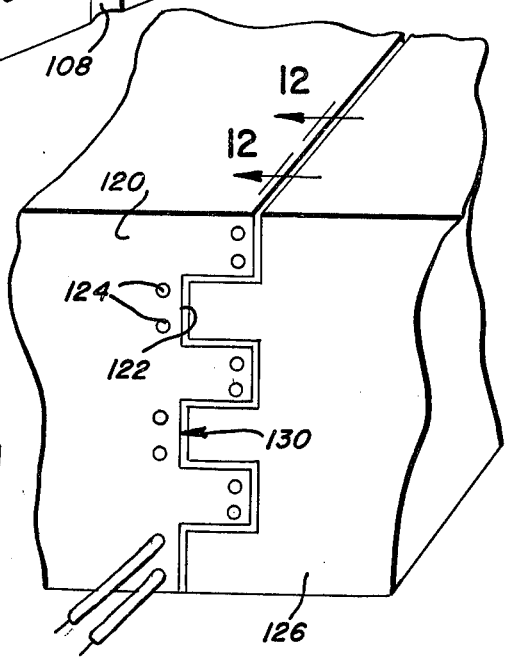
FIG. 11

METHOD AND ASSEMBLY FOR SEALING GAPS BETWEEN ADJACENT ROADWAY SLABS

This invention relates to an improvement in the mode of sealing a narrow gap between adjacent roadway slabs.

A variety of products for sealing gaps or expansion joints between adjacent roadway slabs are known and are in use. Because of the sizes and lengths of the gaps, end dam gap sealing devices cannot generally be manufactured or used in length adequate to accommodate the full length of roadway or deck slab gaps. Accordingly, gap sealing devices are normally provided in modular lengths and are most frequently comprised of a plurality of sections butted together in serial end-to-end array which are sealingly secured to each other. The sections themselves are frequently integrally formed, as from suitable elastomeric material, such as neoprene rubber, and provide end portions which must be sealed to provide a fully sealed gap-sealing device.

Various efforts have been made and approaches taken to provide sealing at the end portions of adjoining sections. However, because the sealing must necessarily be accomplished at the job site where conditions of suitable cleanliness and conditions of close assembly tolerances cannot be satisfied, there still remains the need for improved mechanisms for effecting a seal at the adjacent ends of the modular sections.

For example, an improvement in the mode of effecting a seal between adjacent end-to-end sections in accordance with U.S. Pat. No. 3,713,368 is illustrated in U.S. Pat. No. 3,827,817. Other types of road expansion joint sealing members which require seals between ends of adjacent sections to be fully effective are those shown in U.S. Pat. Nos. 3,650,184, 3,375,763 and 3,881,835. This listing is by no means complete, but it is illustrative of the type of sealing constructions in which improvements in the sealing at end portions of adjacent sections is desirable, and with which the improvements of the present invention may be employed. It will be seen that the improvements of this invention may be employed with a serial array of sealing members extending along a gap between a pair of roadway slabs, whether the gap be transverse, longitudinal or skewed, and that it may also be employed in connection with the sealing of gaps at the intersection of curb and gutter portions of roadway slabs and curb and sidewalk intersections of roadway slabs.

In accordance with a preferred embodiment of this invention, the improvements are employed in association with a roadway joint seal and end dam assembly construction generally in accordance with U.S. Pat. No. 3,713,368. To that end, the improved gap sealing mechanism is provided for sealing a gap between a pair of generally horizontally disposed adjacent, narrowly spaced elongate roadway slabs which are supported for relative movement and which provide upper roadway surfaces. The joint assembly includes an elongate end dam assembly sealingly secured to the slabs at adjacent edges for sealingly bridging the narrow gap between the slabs.

The end dam assembly comprises a plurality of elongated gap sealing members abutting in end-to-end serial array. Each of the sections comprises an elastomeric pad having an upper and a lower surface and end surface portions at each end of the section. Each end provides a surface portion which is adapted to be positioned to confront a complementary surface of the next adjacent member, and which surface portions are intended to be sealed to each other across the width of the members, thereby to provide a sealed joint across the width of the roadway gap.

In accordance with the present invention, the seal between the confronting surfaces is formed in situ. To that end, heating means are provided adjacent the confronting surfaces, which heating means may be energized after the members have been secured to the roadway slabs with the confronting surfaces in mating and confronting relationship. To secure the members to each other at their confronting surfaces, a heat activatable bonding agent is positioned between the confronting surfaces before the second of the members is placed with its surface to be sealed in confronting engagement with the complementary surface of the first of the members.

After the members have been secured to the slabs, and the heat activatable bonding agent has been positioned between the confronting surfaces, the heating means is energized to activate the heat activatable bonding agent, which agent then bonds the confronting surfaces to each other, thereby to seal the surfaces to each other and to provide, in situ, a sealed joint between the members at the confronting surfaces and across the width of the gap.

The heating means preferably comprises a resistance heater. The resistance heater may preliminarily be bonded to one of the confronting surfaces, or it may be embedded in one of the confronting surfaces adjacent that confronting surface. The heat activatable bonding agent may be uncured and vulcanizable rubber and depending upon the nature of the members and the possibility of mismatching of the confronting surfaces in the zone to be sealed, the bonding agent may incorporate an expanding agent, such as a foaming agent, thereby somewhat to expand the bonding agent, and fully to fill and to seal the space between the confronting surfaces. That will provide a most effective seal.

Further objects, features and advantages of this invention will become apparent from the following description and drawings, of which:

FIG. 1 is a fragmentary plan view of a section of a roadway joint sealing assembly in accordance with this invention;

FIG. 2 is an enlarged perspective view of an end dam member made in accordance with this invention;

FIG. 3 is an enlarged cross-sectional view taken substantially along the line 3—3 of FIG. 1;

FIG. 4 is an enlarged, fragmentary perspective view of FIG. 2;

FIG. 5 is an enlarged sectional view taken substantially along the line 5—5 of FIG. 1;

FIG. 6 is a cross-sectional view taken substantially along the line 6—6 of FIG. 5;

FIG. *6a* is a partial sectional view taken substantially along line *6a—6a* of FIG. 6;

FIG. 7 is an exploded view of the assembly of FIG. 6 prior to sealing;

FIG. 8 is an enlarged exploded view of an assembly in accordance with this invention which is similar to that of the embodiment of FIGS. 6 and 7;

FIG. 9 is a perspective view of a further type of sealing assembly adapted to be sealed at end portions in accordance with this invention;

FIG. 10 is a cross-sectional view taken substantially along line 10—10 of FIG. 9;

FIG. 11 is a perspective view of a further type of sealing assembly in accordance with this invention;

FIG. 12 is a view taken substantially along line 12—12 of FIG. 11; and

FIG. 13 is a view illustrating a heater element in accordance with this invention.

FIG. 1 illustrates a roadway joint sealing assembly incorporating an elongated sealing or end dam assembly 1 in accordance with this invention. Although the joint is illustrated as being a transverse joint, a joint transverse of a roadway in which traffic moves in the direction T, of course, longitudinal and skewed gaps between adjacent, relatively movable roadway slabs may also be sealed in accordance with the present invention.

The end dam or sealing assembly comprises a plurality of elongate gap-sealing modular sections or members, such as elastomeric end dam sections 10. Each end dam section 10 includes elongated side pad means comprising a pair of elongated side pads 11. Each side pad 11 provides an upper surface 12 which, when the section is installed, acts as a portion of the upper roadway surface. Each pad 11 is sealingly secured to one of the generally horizontally disposed, narrowly spaced elongate roadway slabs S1 and S2 adjacent gap G, thereby to bridge the narrow gap between the slabs.

Side pads 11 are generally rectangular in cross-section and are sealingly secured to each other, as by sealing means such as a flexible gap-bridging joint membrane 14 which has an upstanding arched configuration. Preferably membrane 14 is integral with side pad 11 and is reinforced with an embedded fabric layer 15. The end dam sections 10 are desirably integrally molded, as of neoprene rubber, and each of the side pads preferably embeds an elongate metal reinforcing plate 16. Plate 16 defines suitable bolt holes 17 to receive bolts or studs 18 by which side pads 11 and the end dam sections 10 are secured to the slabs S1 and S2. The anchoring of the end dam sections 10 is effected via nuts 19 which are threaded onto studs 18. To effect a seal, a layer of a suitable adhesive and sealing agent is positioned in known manner between the lower surfaces of the side pads and the surfaces of the slabs against which they lie.

The modular end dam sections, as will be seen from the drawings, are secured to each other in an end-to-end serial array to form the end dam assembly 1. To that end, a first end of the end dam section 10 provides an extension 14*a* of membrane 14 which projects beyond the ends of the side pads 11. One end of side pads 11 defines first end face portions 20 which extend generally upwardly. The ends of end dam sections 11 merge with a projecting membrane portion 22 which is continuous with the extension 14*a* of membrane 14. The other end of end dam section 10 defines generally upwardly extending end face portions 21 which are substantially complementary to end face portions 20 and also provides complementary notch or groove 23 which defines a surface proportioned to overlie and confront the upper surface of projecting membrane portion 22. The membrane 14 at that end of the end dam section 10 is proportioned to overlie and to confront the extension 14*a* of membrane 14.

As will best be seen in FIGS. 2 and 4, the projecting membrane portions 22 and the adjacent extension 14*a* is provided with an elongate, laterally extending expansive heating means. In the embodiment of FIGS. 2 and 4, the heating means comprises a resistance heater 30. The resistance heater is sealingly bonded and secured to the projecting membrane portions, and may be disposed within a groove or recessed section 31 therein of a size and shape only slightly larger than the heating means so as to snugly receive the heating means and to minimize any adverse effect of the increased thickness which might otherwise result from the presence of the heater thereat. The heater 30 preferably comprises suitable backing or support layers for the conductor elements or conductors 32 comprising the heater, such as fiber-glass surface or support layers 34, and the conductors and the fiberglass support layers 34 are preferably enclosed within an envelope of rubber, such as neoprene rubber which may comprise thin layers 36 of rubber. Leads 38 project from the heater 30.

The resistance heater assembly 30 is preferably bonded in the factory to the membrane portions 14*a* and 22.

When the end dam sections 10 are to be secured to slabs in the field, thereby to seal a roadway joint, an end dam section 10 is first suitably secured to adjacent roadway slabs, as via the studs and nuts 18 and 19. A suitable heat activatable bonding agent, such as a strip 37 of properly compounded unvulcanized rubber, is then applied to the projecting membrane surfaces and in overlying relation to the heater 30. Next, a like end dam section 10 is juxtaposed with the groove 23 overlying membrane portions 14*a* and 22, and this next section is then secured to the roadway slabs, via similar studs and nuts 18 and 19. As this is done, the conductor leads 38 are kept externally of the joint to be formed.

After the end dam sections have been so secured, leads 38 are connected to a suitable external source of electrical power (not shown), and the heater is energized for a period of time suitable to activate the bonding agent so that it bonds the confronting surfaces to each other, thereby to provide, in situ, a sealed joint at the said respective ends across the gap between the adjacent slabs.

A variety of suitable heat activatable bonding formulations may be used. However, a preferred bonding agent comprises unvulcanized rubber, such as neoprene rubber, preferably compounded with a minor amount of an expanding agent, such as a foaming agent. When an expanding or foaming agent is provided, to the extent that there is any mismatching of the confronting surfaces in the zone to be sealed, the capacity of the bonding agent to expand slightly enhances the complete filling of the space between the surfaces, thereby to complete effective bonding, via the bonding agent, of the confronting surfaces. It is preferred that the amount of expanding or foaming agent which is used will be limited to that amount which will enable the bonding agent to approximately double in volume. A suitable heat activatable bonding formulation comprises neoprene with about five percent by weight of a blowing agent, such as N'N-dinitrosopentamethylene tetramine having suitable amounts of fillers, plasticizers, accelerators, curing agents and process aids. The neoprene is compounded to be chemically blown and to have good weather resistance, good adhesion to the materials to which it is to adhere and good tear strength. In any event, the amount of foaming or expanding to be permitted should be limited, depending upon the application to an amount which will not create excessive pressure, thereby substantially to avoid distorting or deforming the confronting parts which might otherwise impede or adversely affect their intended functioning. Some induced pressure is advantageous for providing a secure and effective seal and bond.

Prior to assembly and to securing the end dam sections to the roadway, it will be desirable to clean and prime the confronting rubber surfaces in a known manner so that the bonding agent will provide the most effective seal.

It is preferable to secure the resistance heater 30 to one end of the end dam section in the factory or in the plant prior to shipment. This will minimize possible problems in properly placing it and will require the bonding of the heater in in the field to only one of the two confronting surfaces to be sealed. However, it is clear that it is possible to provide a separate resistance heater assembly which may be positioned, at the job site, against and between the pair of surfaces to be bonded, with suitable amounts of heat activatable bonding agent 37' positioned between each of the surfaces to be sealed and the heater 30', as is illustrated by FIG. 8 which is otherwise like FIG. 7 and in which similar primed part numbers have been used. It is also possible to provide a heating element which has the bonding agent fast with it thereby to form, in effect, an envelope so that the combined heating element and bonding agent may be positioned between the surfaces to be sealed for bonding and sealing in the manner just described.

Of course, it is important to control the amount of heat applied so that proper bonding occurs, so that the rubber is suitably vulcanized, but without causing the rubber to deteriorate or degrade. Accordingly, sufficient heat is provided for curing, but not enough heat is provided to cause the rubber to deteriorate. The amount of heat to be applied will depend upon the amount of rubber to be cured or other bonding agent to be activated, and the nature and thickness of the parts to be bonded to each other. Indeed, depending upon the heat requirements of the shapes and volumes of the parts to be bonded, the resistance heater may be configured to provide a greater heat input at some locations and a lesser heat input at other locations. Thus, for example, as shown in FIG. 13, a resistance heater element **30*a* may have a pattern as schematically illustrated thereby. Heater 30*a* may be used in the same environment as heater 30. Such a heater will generate a greater heat output and density in the area of the membrane portion 14*a*** (where the pattern is denser) where heat losses will be greater during vulcanization than in the area where the side pads provide a greater insulating effect against heat loss and where the pattern of the conductors is less dense.

In the embodiment illustrated in FIGS. 1 to 7, in which the side pads were approximately $5 \times 1\frac{1}{2}$ inches in cross-section, and in which membrane portions 22 and membrane **14*a*** were approximately $\frac{1}{8}$ inch in thickness, it has been found that a resistance heater which produces about five watts per square inch produces sufficient heat during a period of about 15 minutes with an unvulcanized foaming rubber formulation comprising a strip of rubber about 1 inch in width by about $\frac{1}{8}$ inch in thickness to provide a suitable seal and suitably to bond the parts to each other.

In the embodiment of FIG. 7, the resistance heater 30 was described as being positioned in a groove 31 and as being bonded therein after formation of the end dam section 10. Where feasible, it is preferred that the heater 30 be secured to an end dam section during molding of the section 10. In such a case a typical heater 11 will be disposed in the mold for section 10 and may be formed flush with membrane portions **14*a* and 22. When so molded, the end dam section 10 is ready for use in the manner previously described by the juxtaposition of appropriately configured sections 10 with an interposed strip 37** of bonding agent.

Although the preferred embodiment described shows bonding via a membrane, such as via membrane portions **14*a* and 22, it is also possible to employ this invention in the sealing of confronting butting elastomeric surfaces such as those illustrated in FIGS. 9 and 10. As there shown, a pair of abutting gap sealing members 100 provide adjacent confronting end surfaces 102 and 104. A resistance heater 106 is positioned between them, and suitable amounts of a heat activatable bonding agent 108 are positioned also between surfaces 102 and 104. After the assembly is secured to the roadway slabs, as in the manner generally described above, the resistance heater is energized via leads 110 for a period of time suitable to vulcanize the bonding agent, thereby to bond the confronting surfaces 102 and 104** to each other.

Although the resistance heater in the embodiments just described has been described as a separated resistance heater element, it is apparent that the resistance heater may be embedded in one or the other of the confronting surfaces to be sealingly bonded to each other.

As shown in FIGS. 11 and 12, a first gap sealing member 120 defines an end surface 122 which is grooved in a square wave type pattern. Adjacent the end surface 122, and slightly within the end face, a suitable plurality of conductors or conductor elements 124 which will act to serve as a resistance heater are embedded. An adjacent gap sealing member 120 defines a complementary grooved surface. Gap sealing members 120 and a complementary gap sealing member 126 are suitably secured to the roadway slabs in confronting engagement. A suitable heat activatable bonding agent 130 is provided between those surfaces. After members 120 and 126 have been secured, the resistance heater conductors 124 are energized for a period of time sufficient to effect a bond and seal between the confronting surfaces via the heat activatable bonding agent 130.

It is apparent that the provisions of a heating means in the joint to be sealed, whether electric or chemical, makes it possible to install the elements or sections to be sealingly bonded to each other and then to seal them to each other in situ. This provides a more certain and effective seal than bonding prior to installation, as by a splicing unit into which the parts to be spliced or joined may be inserted. Indeed, in many environments in which the method of this invention may be employed, as at the intersection of curbs and gutters or curb and sidewalk members to be sealingly bonded to each other, such as of the types illustrated in U.S. Pat. Nos. 3,650,184 and 3,881,835, the use of a separate splicing unit would be virtually impossible in any practical sense.

It is also apparent that this invention may be employed in connection with sealing sub-gaps in large motion gap environments. Thus the gap to be sealed between adjacent slabs may be sealed by gap sealing members which entirely bridge the gap and which are secured directly to the slabs or may be a sub-gap which is sealed by a sub-gap sealing member which is disposed in the roadway to span the sub-gap and which is secured directly or indirectly to the adjacent roadway slabs. Accordingly, where the term roadway gap is used herein, it is intended to embrace both the full gap between the slabs and sub-gaps between adjacent slabs.

While this invention is susceptible of embodiment in many different forms, there is shown in the drawing and has been described herein in detail specific embodiments of the invention, with the understanding that the present disclosure is to be considered as an exemplification of the principals of the invention and is not intended to limit the invention to the embodiments illustrated.

What is claimed is:

1. A roadway joint sealing assembly for providing a sealed joint between a pair of elongate adjacent roadway slabs which are spaced from each other to define a gap therebetween, comprising:

a first elongated gap sealing member spanning said gap and anchored to said slabs and having a first elastomeric confronting end surface;

a second elongated gap sealing member spanning said gap and anchored to said slabs and having a second elastomeric confronting end surface having a configuration generally complementing the shape of said first confronting end surface for mating and abutting confrontation therewith;

heat activatable bonding agent comprising an envelope of vulcanizable rubber-like material spanning said gap and disposed between said first and second confronting surfaces; and expansive heating means secured to one of said confronting end surfaces and comprising electrical conductor means within said envelope positioned to remain in situ, spanning said gap and cooperating with and disposed adjacent at least one of said confronting surfaces for heating said heat activatable bonding agent to sealingly bond said confronting surfaces to each other, leads coupled to said electrical conductor means and extending outwardly of said envelope and outwardly of said gap sealing members for energizing said conductor means, thereby to provide in situ, when said conductor means is energized a vulcanized sealed joint at said respective end surfaces across at least a portion of said gap.

2. A roadway joint sealing assembly in accordance with claim 1 wherein said conductor means are constructed and arranged to generate a greater heat density along some portions of said confronting end surfaces than along other portions of said confronting end surfaces.

3. A roadway joint sealing assembly in accordance with claim 1 wherein the heat activatable bonding agent is expandible unvulcanized rubber.

4. A method of sealing a gap in a roadway between adjacent roadway slabs with a series of elongate gap sealing members positioned in an end-to-end array in the direction of the gap comprising the steps of:

providing first and second gap sealing members for bridging the gap, said first and second members each defining an elastomeric end surface to be sealed to each other, securing a first gap sealing member in said roadway in the direction of said gap to bridge said gap, securing said second gap sealing member in said roadway to bridge said gap and with elastomeric end surfaces of said first and second gap sealing members adjacent each other in abutting confronting relationship and with heating means positioned adjacent said confronting end surfaces and with a heat activatable bonding agent disposed between said end surfaces adjacent said heating means, and energizing said heating means in situ to activate said bonding agent to bond and seal said confronting elastomeric end surfaces to each other, thereby to generate in situ a sealed joint between said members at said confronting surfaces across said gap, and further including the step of foaming and expanding said heat activatable bonding agent when it is activated by said heating means, said expansion exerting less than a predetermined amount of pressure against said confronting surfaces so as to substantially avoid deforming said confronting surfaces.

5. A method in accordance with claim 4 wherein said bonding agent comprises unvulcanized rubber, and said energizing step comprises vulcanizing said rubber to bond said confronting elastomeric end surfaces to each other.

6. A method in accordance with claim 4 wherein said heating means comprises a separate resistance heater, and said method further comprises the steps of positioning said heater against a said surface after one of said members is anchored to said slabs.

* * * * *